US010344733B2

(12) United States Patent
Koda et al.

(10) Patent No.: US 10,344,733 B2
(45) Date of Patent: Jul. 9, 2019

(54) INTERNAL COMBUSTION ENGINE IGNITION APPARATUS

(71) Applicant: Mitsubishi Electric Corporation, Tokyo (JP)

(72) Inventors: Takeshi Koda, Hyogo (JP); Ryo Sakaguchi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/784,323

(22) Filed: Oct. 16, 2017

(65) Prior Publication Data

US 2018/0306162 A1 Oct. 25, 2018

(30) Foreign Application Priority Data

Apr. 20, 2017 (JP) ..... 2017-083338

(51) Int. Cl.
*F02P 3/05* (2006.01)
*F02P 3/04* (2006.01)
(Continued)

(52) U.S. Cl.
CPC ..... *F02P 3/05* (2013.01); *F02P 3/01* (2013.01); *F02P 5/103* (2013.01); *F02P 5/1516* (2013.01);
(Continued)

(58) Field of Classification Search
CPC .. F02P 3/005; F02P 3/0407; F02P 3/05; F02P 3/103; F02P 3/106; F02P 3/145; F02P 3/153
See application file for complete search history.

(56) References Cited

U.S. PATENT DOCUMENTS 6,057,652 A * 5/2000 Chen ..... H05B 41/28 315/219
7,188,023 B1 * 3/2007 O'Daniel ..... F02D 41/0087 123/406.14
(Continued)

FOREIGN PATENT DOCUMENTS

JP 2004263612 A * 9/2004
JP 200677763 A 3/2006
(Continued)

OTHER PUBLICATIONS

Communication dated Apr. 3, 2018, from the Japanese Patent Office in counterpart application No. 2017-083338.

*Primary Examiner* — John M Zaleskas
(74) *Attorney, Agent, or Firm* — Sughrue Mion, PLLC; Richard C. Turner

(57) ABSTRACT

There is provided an internal combustion engine ignition apparatus that can effectively raise the ignitability of an inflammable fuel-air mixture, by applying electric power corresponding to the combustion state of an internal combustion engine. A combustion state detection apparatus detects an combustion state inside a combustion chamber of the internal combustion engine; based on the combustion state detected by the combustion state detection apparatus in accordance with an operation state of an ignition coil apparatus, a current supply apparatus supplies an AC current to a spark discharge path formed in the gap of an ignition plug; then, a control apparatus controls the output of the current supply apparatus.

5 Claims, 9 Drawing Sheets

(51) Int. Cl.

| | |
|---|---|
| ***F02P 5/10*** | (2006.01) |
| ***F02P 5/15*** | (2006.01) |
| ***F02P 3/01*** | (2006.01) |
| ***F02P 9/00*** | (2006.01) |
| ***F02P 15/10*** | (2006.01) |
| *F02P 17/12* | (2006.01) |

(52) U.S. Cl.
CPC ..... *F02P 9/007* (2013.01); *F02P 15/10* (2013.01); *F02P 3/0407* (2013.01); *F02P 9/002* (2013.01); *F02P 2017/125* (2013.01)

(56) References Cited

U.S. PATENT DOCUMENTS

2006/0021607 A1 2/2006 Toriyama
2009/0108846 A1* 4/2009 Koda ..... F02D 35/021 324/391
2009/0309499 A1* 12/2009 Agneray ..... F02P 9/007 315/111.21
2010/0257921 A1* 10/2010 Tanaya ..... G01M 15/042 73/114.67
2010/0258081 A1* 10/2010 Tanaya ..... F02P 5/1502 123/406.58
2013/0214689 A1* 8/2013 Katsuraya ..... F02P 9/007 315/174
2014/0116405 A1* 5/2014 Tanaya ..... F02P 3/02 123/634
2014/0145624 A1* 5/2014 Ban ..... F02P 3/01 315/172
2014/0261346 A1* 9/2014 Tanaya ..... F02P 3/02 123/594
2014/0306617 A1* 10/2014 Tanaya ..... H01T 15/00 315/223
2015/0115827 A1* 4/2015 Itoi ..... H01T 15/00 315/224
2016/0138552 A1* 5/2016 Itoi ..... F02P 9/002 315/127
2016/0195055 A1* 7/2016 Suzuki ..... F02D 41/1497 123/406.16
2016/0281672 A1* 9/2016 Momino ..... F02P 5/145

FOREIGN PATENT DOCUMENTS

JP 2007138802 A * 6/2007
JP 2009257112 A 11/2009
JP 4497027 B2 7/2010
JP 5351874 B2 11/2013
JP 2014211148 A 11/2014

* cited by examiner

INTERNAL COMBUSTION ENGINE IGNITION APPARATUS

BACKGROUND OF THE INVENTION

Field of the Invention

The present invention relates to an internal combustion engine ignition apparatus that ignites an internal combustion engine by making a high-frequency AC current flow into a spark discharge path so as to form discharge plasma in a gap between the electrodes of an ignition plug.

Description of the Related Art

In recent years, the issues such as environment preservation and fuel depletion have been raised; measures for these issues are urgently required also in the automobile industry. As an example of the measures, there exist a method for drastically improving the amount of fuel consumption in an internal combustion engine through an internal combustion engine in which an exhaust gas recirculation (EGR) apparatus for recirculating part of exhaust gas to the intake port is mounted, engine downsizing and engine weight-saving achieved by use of a supercharger, and the like.

In some cases, when the EGR amount is increased, the proportion of air to be taken into the combustion chamber decreases and hence unevenness is caused in the distribution of an inflammable fuel-air mixture; thus, there exists a problem that the deterioration of ignitability causes a torque fluctuation and the like.

For the purpose of solving this problem, for example, each of Patent Documents 1 and 2 proposes an ignition apparatus utilizing a method in which in an ignition apparatus utilizing a capacitive discharging method, a spark discharge is made to continue for a long time so that a lot of temporal igniting opportunities are provided and hence the unevenness in the distribution of an inflammable fuel-air mixture is absorbed.

It is known that when an internal combustion engine utilizing a supercharger is in a high-supercharge mode, the pressure inside the combustion chamber of the internal combustion engine becomes extremely high even when no combustion occurs and hence it is difficult in this situation to produce a spark discharge for starting combustion. One of the reasons why it is difficult to produce a spark discharge when the pressure inside the combustion chamber of the internal combustion engine is high is that the required voltage for causing a dielectric breakdown in a gap between the central electrode and the ground electrode of an ignition plug becomes high and exceeds the withstanding voltage value of the insulating porcelain of the ignition plug.

In order to solve the foregoing problem, there have been made studies for raising the withstanding voltage of an ignition-plug porcelain; however, in an actual situation, it is difficult to secure a sufficient withstanding voltage for the required withstanding voltage.

Accordingly, to date, a means for narrowing the gap of an ignition plug could not have helped being taken. However, when the gap of the ignition plug is narrowed, the effect of the flame extinguishing action of the electrode portion becomes large; thus, there is posed a new problem that the startability and the combustion performance are deteriorated.

For the purpose of solving this problem, there can be conceived avoidance means such as providing energy, which is larger than the heat taken away by the electrode portion through the flame extinguishing action, to a spark discharge and causing combustion at a position that is as far away from the electrodes as possible; as an ignition apparatus in which one of the avoidance means is adopted, for example, Patent Document 2 proposes a high-frequency discharge ignition apparatus.

In an ignition apparatus disclosed in Patent Document 1, a dielectric breakdown is caused between the electrodes of an ignition plug, through a capacitive discharging method; then, after the dielectric breakdown between the electrodes of the ignition plug utilizing the capacitive discharging method, an AC spark discharge is continuously produced between the electrodes of the ignition plug, through an inductive discharging method. The inductive discharging method is a discharging method in which energy is continually supplied from a coil in which the energy is preliminarily accumulated to the primary coil of an ignition coil apparatus so that an AC spark discharge is continuously produced between the electrodes of an ignition plug.

A high-frequency discharge ignition apparatus disclosed in Patent Document 2 is an apparatus in which a spark discharge is produced between the electrodes of an ignition plug by a conventional ignition coil and large AC plasma is formed between the electrodes of the ignition plug, by making a high-frequency AC current flow into the spark discharge path.

PRIOR ART REFERENCE

Patent Document

[Patent Document 1] Japanese Patent Publication No. 4497027

[Patent Document 2] Japanese Patent Publication No. 5351874

In the ignition apparatus disclosed in Patent Document 1, there is demonstrated an effect that by realizing a long term discharge, temporal igniting opportunity increases and hence extinction is prevented. However, the variation in igniting timings cannot be suppressed and hence there remains problems in terms of improvement of the variation in the torque to be produced by an internal combustion engine, improvement of the drivability, and the like. In order to solve these problems, it is required to increase the spatial igniting opportunity. As a method of increasing the spatial igniting opportunity, a high-frequency ignition apparatus, described in Patent Document 2, has been disclosed; the high-frequency ignition apparatus can prevent extinction and can suppress the variation in the torque to be produced, because it can form AC plasma.

The high-frequency ignition apparatus disclosed in Patent Document 2 can provide energy larger than the heat that is taken away by the electrode portion due to flame extinguishing action of the ignition plug, and hence it is made possible to increase the spatial igniting opportunity; thus, ignition can be performed even in an internal combustion engine in which the distance between the electrodes of the ignition plug is narrowed. However, there has been a problem that because AC plasma is produced between the electrodes of an ignition plug, the electrodes of the ignition plug are abraded.

Furthermore, in the ignition apparatus disclosed in Patent Document 2, AC electric power is supplied in order to produce and maintain AC plasma; thus, the total energy to be supplied to the electrodes can be reduced.

However, as is well known, the condition of a spark discharge in an internal combustion engine is liable to change and hence the range of electric power that can maintain the spark discharge changes; thus, when as disclosed in Patent Document 2, all of the supplied electric power is reduced, the condition of a spark discharge becomes unstable Therefore, there has been a problem that when a spark-discharge interruption occurs, the period (discharging time) in which the spark discharge can be maintained becomes short and hence the ignitability of the inflammable fuel-air mixture cannot sufficiently be raised.

The present invention has been implemented in order to solve the foregoing problems in conventional ignition apparatuses; the objective thereof is to provide an internal combustion engine ignition apparatus that can effectively raise the ignitability of an inflammable fuel-air mixture by applying electric power corresponding to the combustion state of the internal combustion engine.

SUMMARY OF THE INVENTION

An internal combustion engine ignition apparatus according to the present invention is characterized by including an ignition plug that is provided with two or more electrodes facing each other through a gap and produces a spark discharge in the gap so that an inflammable fuel-air mixture inside a combustion chamber of an internal combustion engine is ignited, an ignition coil apparatus that supplies a predetermined ignition voltage to the ignition plug so as to form a spark discharge path in the gap, a resonance apparatus that forms a band-pass filter, a current supply apparatus that supplies an AC current to the spark discharge path formed in the gap, by way of the resonance apparatus, a combustion state detection apparatus that detects an combustion state inside the combustion chamber of the internal combustion engine, and a control apparatus that controls an output of the current supply apparatus, based on the combustion state detected by the combustion state detection apparatus in accordance with an operation state of the ignition coil apparatus.

An internal combustion engine ignition apparatus according to the present invention makes it possible to adjust electric power to be applied for AC plasma, in accordance with the combustion state of an internal combustion engine; thus, a spark-discharge interruption can be prevented from deteriorating the combustion or causing a misfire. Moreover, an internal combustion engine ignition apparatus according to the present invention makes it possible to improve the lifetime of an ignition plug, by suppressing electric power to be applied for AC plasma.

The foregoing and other object, features, aspects, and advantages of the present invention will become more apparent from the following detailed description of the present invention when taken in conjunction with the accompanying drawings.

DETAILED DESCRIPTION OF THE PREFERRED EMBODIMENTS

Hereinafter, a high-frequency discharge ignition apparatus according to each of Embodiments 1 through 4 of the present invention will be explained.

Embodiment 1

Figure 1:
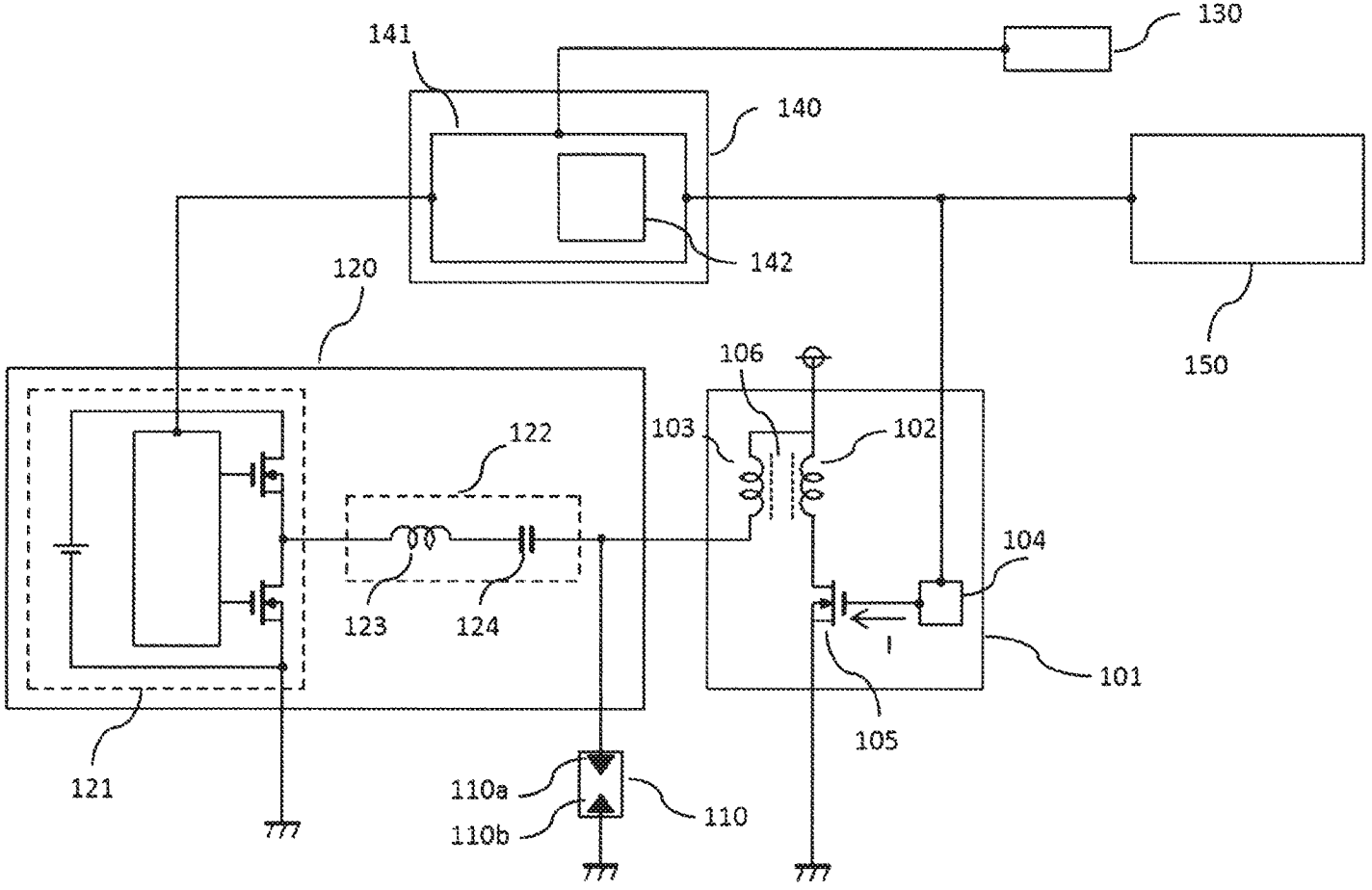
FIG. 1 is a configuration diagram of a high-frequency discharge ignition apparatus according to each of Embodiments 1, 3, and 4 of the present invention.

FIG. 1 is a configuration diagram of a high-frequency discharge ignition apparatus according to each of Embodiments 1, 3, and 4 of the present invention. In a high-frequency discharge ignition apparatus according to Embodiment 1 of the present invention, a spark discharge is produced between the electrodes of an ignition plug by use of a high voltage generated by an ignition coil; in addition to that, large AC plasma is formed between the central electrode and the ground electrode of the ignition plug by making a high-frequency AC current flow into the spark discharge path.

FIG. 1, the high-frequency discharge ignition apparatus according to Embodiment 1 of the present invention is mounted in a vehicle or the like and includes an energy supply apparatus 120, an ignition coil apparatus 101, a control apparatus 140, and a combustion state detection apparatus 130 for detecting a combustion state of an internal combustion engine; a spark discharge and plasma are produced in a gap between a central electrode 110*a* and a ground electrode 110*b* of an ignition plug 110 so that an inflammable fuel-air mixture in the internal combustion engine is ignited.

In one and the same package, the energy supply apparatus 120 incorporates a resonance apparatus 122 including an inductor 123 and a capacitor 124 and a current supply apparatus 121 that supplies an AC current to a spark discharge path formed in the gap between the central electrode 110*a* and the ground electrode 110*b* of the ignition plug 110, by way of the resonance apparatus 122. The current supply apparatus 121 is formed of a switching circuit that generates an AC current.

The ignition coil apparatus 101 has a primary coil 102 and a secondary coil 103 that are magnetically coupled with each other through a core 106, a switching device 105 that controls energization of the primary coil 102, and a driving apparatus 104 that drives the switching device 105. The driving apparatus 104 drives the switching device 105 in accordance with an instruction from an internal-combustion-engine control unit (referred to as an ECU, hereinafter) 150. The control apparatus 140 is formed of a microprocessor 141 including an ignition detection apparatus 142.

The resonance apparatus 122 includes the inductor 123 and the capacitor 124 that configure a band-pass filter and supplies an AC current generated by the current supply apparatus 121 to the spark discharge path formed in the gap between the central electrode 110*a* and the ground electrode 110*b* of the ignition plug 110; concurrently, the resonance apparatus 122 blocks a high voltage generated across the secondary coil 103 of the ignition coil apparatus 101 from being applied to the current supply apparatus 121.

As described above, the energy supply apparatus 120 incorporates the resonance apparatus 122 and the current supply apparatus 121 in one and the same package; in the case where in such a manner as described above, the resonance apparatus 122 and the current supply apparatus 121 are provided in one and the same package, there exists no electrical transmission path between the resonance apparatus 122 and the current supply apparatus 121 and hence it can be suppressed that high frequency noise such as conductive noise, which is transmitted through the electrical transmission path, or radiation noise, which comes through the space, provides an effect to other apparatuses.

There may be adopted a method in which the resonance apparatus 122 and the current supply apparatus 121 are not provided in one and the same package but arranged to be adjacent to each other so that the electrical transmission path is shortened or a method in which the resonance apparatus 122 and the current supply apparatus 121 are directly connected with each other by use of a connector.

Also with regard to the energy supply apparatus 120 and the ignition plug 110, when the energy supply apparatus 120 and the ignition plug 110 are directly connected with each other, for example, by use of a connector, there exists no electrical transmission path and hence the high frequency noise can be suppressed. In the case where the energy supply apparatus 120 and the ignition plug 110 are directly connected with each other, it is required to dispose the energy supply apparatus 120 in the vicinity of the internal combustion engine; thus, it is desirable that the energy supply apparatus 120 is formed of a compact package including only the resonance apparatus 122 and the current supply apparatus 121.

As described above, the control apparatus 140 has the microprocessor 141; in accordance with the operation of the driving apparatus 104 in the ignition coil apparatus 101, the control apparatus 140 determines the way of operation of the current supply apparatus 121 and then controls the current supply apparatus 121; in addition to that, the control apparatus 140 detects the combustion state of the internal combustion engine, based on a signal from the combustion state detection apparatus 130. Furthermore, the control apparatus 140 has the ignition detection apparatus 142 that detects in an after-mentioned manner a signal with which the ECU 150 instructs the driving apparatus 104 to operate.

It may be allowed that the control apparatus 140 is contained in a package that is the same as that of the ECU 150 or in a package that is the same as that of the energy supply apparatus 120. Instead of the ECU 150, an apparatus, which can output a signal for driving the driving apparatus 104 of the ignition coil apparatus 101, can be utilized.

The combustion state detection apparatus 130 is an apparatus for detecting the combustion state of the internal combustion engine, and is formed of any one of a sensor for detecting the rotation speed of the internal combustion engine, a sensor for detecting an ion current, an inner-cylinder pressure sensor for detecting an inner-cylinder pressure, and an $O_2$ sensor for detecting an oxygen concentration or formed through the combination of any two of them. In the high-frequency discharge ignition apparatus according to Embodiment 1 of the present invention, a sensor for detecting the rotation speed of the internal combustion engine is provided; based on the rotation speed of the internal combustion engine detected by the sensor, the combustion state of the internal combustion engine is detected.

Specifically, the ignition coil apparatus 101 produces a spark discharge in the gap between the central electrode 110*a* and the ground electrode 110*b* of the ignition plug 110; after that, a high-frequency AC power (referred to as RF electric power, hereinafter) is applied between the central electrode 110*a* and the ground electrode 110*b* of the ignition plug 110 so that AC plasma is produced. In Embodiment 1, the control apparatus 140 is electrically connected with the combustion state detection apparatus 130 for detecting the combustion state of the internal combustion engine; based on a signal outputted from the combustion state detection apparatus 130, the control apparatus 140 performs high-frequency ignition control in accordance with the operation state of the internal combustion engine.

The current supply apparatus 121 of the energy supply apparatus 120 generates RF electric power for producing AC plasma in the gap between the central electrode 110*a* and the ground electrode 110*b* of the ignition plug 110 that produces a spark discharge.

As a means for making a spark discharge occur in the gap between the central electrode 110*a* and the ground electrode 110*b* of the ignition plug 110, the ignition coil apparatus 101 including the primary coil 102 and the secondary coil 103 is provided. The switching device 105 is turned on in order to energize the primary coil 102, so that energy is accumulated in the ignition coil apparatus 101. Then, when the switching device 105 is turned off in order to cut off the energization of the primary coil 102, a high-voltage DC electric power is generated across the secondary coil 103 and hence a spark discharge is made to occur in the gap between the central electrode 110*a* and the ground electrode 110*b* of the ignition plug 110.

The resonance apparatus 122 combines the DC electric power generated by the ignition coil apparatus 101 with the RF electric power generated by the current supply apparatus 121 and then supplied the combined electric power to the ignition plug 110. The resonance apparatus 122 includes the inductor 123 and the capacitor 124. The inductor 123 electrically connects the ignition plug 110 with the current supply apparatus 121 and suppresses the RF electric power generated by the current supply apparatus 121 from flowing into the ignition coil apparatus 101. The capacitor 124 electrically connects the current supply apparatus 121 with the ignition plug 110 and the ignition coil apparatus 101 and suppresses the DC electric power generated by the ignition coil apparatus 101 from flowing into the current supply apparatus 121.

The control apparatus 140 instructs the ignition coil apparatus 101 to energize the primary coil 102 in such a way that the RF electric power is applied to the ignition plug 110 after a spark discharge has been produced in the gap between the central electrode 110*a* and the ground electrode 110*b* of the ignition plug 110, and concurrently instructs the current supply apparatus 121 to generate the RF electric power. The control apparatus 140 controls the current supply apparatus 121 in accordance with the combustion state of the internal combustion engine to be detected by the combustion state detection apparatus 130, so that the current supply apparatus 121 can generate RF electric power suitable for the operation state of the internal combustion engine.

Figure 2:
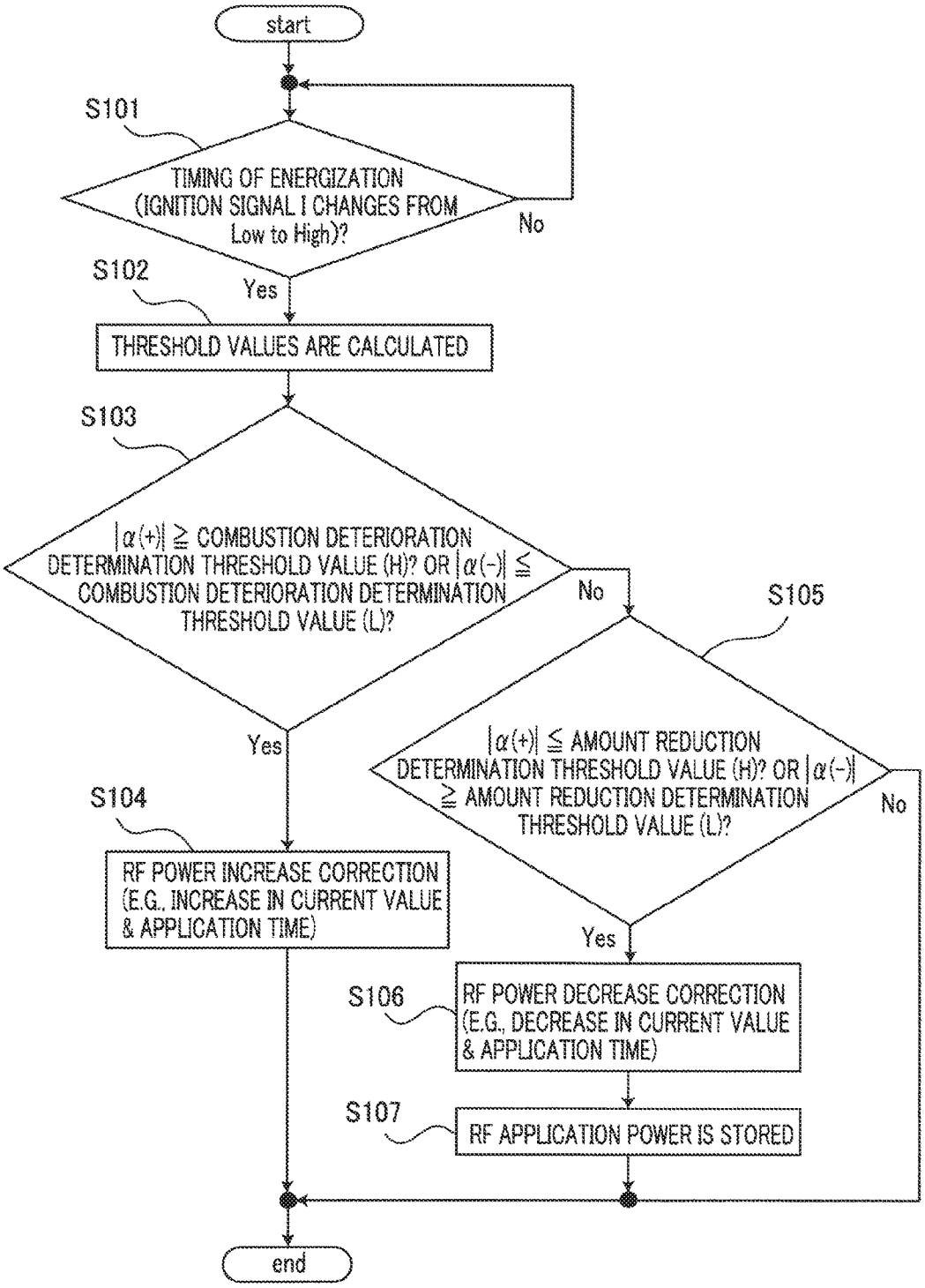
FIG. 2 is a flowchart representing the control procedure of a high-frequency discharge ignition apparatus according to Embodiment 1 of the present invention.

Next, there will be explained the operation of the high-frequency discharge ignition apparatus, according to Embodiment 1 of the present invention, that is configured in such a manner as described above. FIG. 2 is a flowchart representing the control procedure of the high-frequency discharge ignition apparatus according to Embodiment 1 of the present invention. In FIG. 2, at first, in the step S101, the ignition detection apparatus 142 in the control apparatus 140 detects the timing when the level of an ignition signal of the driving apparatus 104 in the ignition coil apparatus 101 changes from Low level to High level. In this case, the timing when the level of the ignition signal I of the driving apparatus 104 changes from Low level to High level is the timing when the switching device 105 in the ignition coil apparatus 101 turns on and hence energization of the primary coil 102 starts.

The microprocessor 141 in the control apparatus 140 detects the output signal of the combustion state detection apparatus 130 at the timing when the level of the ignition signal I of the driving apparatus 104 detected by the ignition detection apparatus changes from Low level to High level. In Embodiment 1, the output signal of the combustion state detection apparatus 130 is formed of a signal corresponding to the rotation speed of the internal combustion engine. The microprocessor 141 obtains a rotation speed changing value (referred to as a [rotation change α], hereinafter) of the internal combustion engine, based on an output signal corresponding to the rotation speed of the internal combustion engine, which is the output signal of the combustion state detection apparatus 130. Because the calculation method for the rotation change α is a well-known technique, the explanation therefore will be omitted, here.

Next, in the step S102, determination threshold values are calculated. The determination threshold values denote a combustion deterioration determination threshold value for determining deterioration in the combustion and an amount reduction determination threshold value for reducing the RF electric power. In Embodiment 1, the determination threshold values are calculated based on an after-mentioned background level (referred to as BGL, hereinafter).

Figure 3:
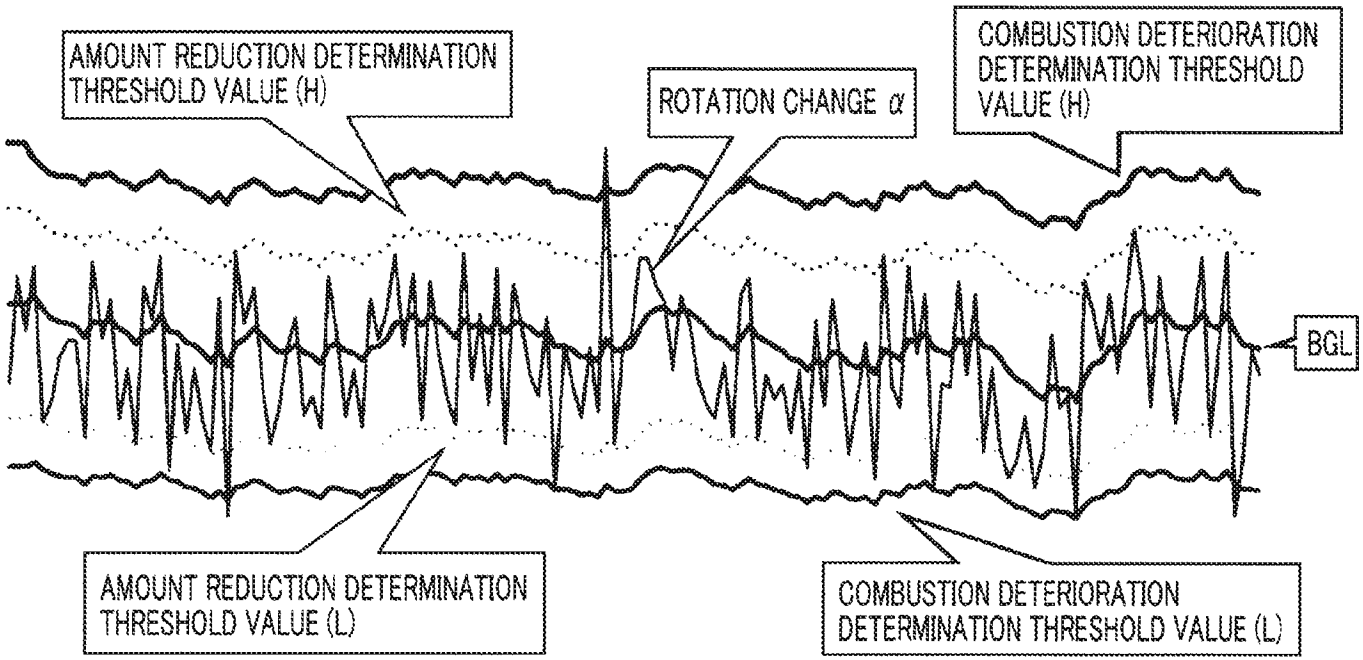
FIG. 3 is a waveform chart representing the background level of the output signal of a combustion state detection device and threshold values in the high-frequency discharge ignition apparatus according to Embodiment 1 of the present invention.

FIG. 3 is a waveform chart representing the background level of the output signal of the combustion state detection apparatus and threshold values in the high-frequency discharge ignition apparatus according to Embodiment 1 of the present invention; FIG. 3 represents the rotation change α, BGL, a high-level-side amount reduction determination threshold value (H), a low-level-side amount reduction determination threshold value (L), a high-level-side combustion deterioration determination threshold value (H), and a low-level-side combustion deterioration determination threshold value (L). It may be allowed that without utilizing BGL, the determination threshold values are set to fixed values based on respective maps (referred to as MAP, hereinafter) for operation conditions of the internal combustion engine.

The foregoing BGL is calculated by use of the equation (1) below, based on the rotation change α. In the equation (1), K, BGL (n−1), and Value denote the filter coefficient of BGL, 1-ignition-prior BGL, and the value of the rotation change α, respectively.

$$BGL=K\times BGL(n-1)+(1-K)\times Value \quad (1)$$

BGL calculated according to the equation (1) is adopted as the reference; BGL is offset toward the positive side with respect to the reference so that the combustion deterioration determination threshold value (H) is calculated; BGL is offset toward the negative side so that the combustion deterioration determination threshold value (L) is calculated. The offset amount of the foregoing BGL may be a fixed value or may be changed depending on the operation condition of the internal combustion engine. It may be allowed that based on the operation information such as the rotation speed of the internal combustion engine, the load thereon, and the water temperature thereof, respective MAPs for the combustion deterioration determination threshold value (H) and the combustion deterioration determination threshold value (L) are provided.

In the case where the rotation change α is small, it is determined that the combustion state is stable, and then the RF electric power is reduced. With regard to the amount reduction determination threshold values for determining that the combustion state is stable, the proportion of the combustion deterioration determination threshold value (H) to BGL is set to P1(%) and the proportion of the combustion deterioration determination threshold value (L) to BGL is set to P2(%). As is the case with the combustion deterioration determination threshold value (H) and the combustion deterioration determination threshold value (L) the proportions P1(%) and P2(%) may be fixed values or may be changed depending on the operation condition of the internal combustion engine; alternatively, based on the operation information such as the rotation speed of the internal combustion engine, the load thereon, and the water temperature thereof, MAPs for the proportions P1(%) and P2(%) may be provided.

In FIG. 2, after the determination threshold values are determined in the foregoing step S102, the comparison between the rotation change α and the combustion deterioration determination threshold value (H) or the combustion deterioration determination threshold value (L) is performed in the step S103. That is to say, in the case where the rotation change α is a positive value, the comparison between the rotation change α and the combustion deterioration determination threshold value (H) is performed; in the case where the rotation change α is a negative value, the comparison between the rotation change α and the combustion deterioration determination threshold value (L) is performed. In the case where the result of the comparison in the step S103 indicates that [|rotation change α(+)|≥the combustion deterioration determination threshold value (H)] is established. (Yes) or in the case where the result of the comparison in the step S103 indicates that [|rotation change α(−)|≤the combustion deterioration determination threshold value (L)] is established (Yes), it is determined that the combustion state has been deteriorated, and then the S103 is followed by the step S104. In the case where the result of the comparison in the step S103 indicates that [|rotation change α(+)|≥the combustion deterioration determination threshold value (H)] is not established (No) or in the case where the result of the comparison in the step S103 indicates that [|rotation change α(−)|≤the combustion deterioration determination threshold value (L)] is not established (No), it is determined that the combustion state has not been deteriorated, and then the step S105.

In the step S104, a correction amount for increasing the RF electric power is determined, and then the processing is ended. The determination of the correction amount is performed, for example, in such a manner that the RF current value is increased (for example, increased from 3 [A] to 5 [A]), that the RF application time is increased (for example, prolonged from 100 [us] to 500 [us]), or that like multiple ignition, the RF is applied twice or more times. As is the case with the step S102, the correction amount for the RF electric power may be a fixed value or may be changed depending on the operation condition; alternatively, based on the operation information, MAP may be provided.

In contrast, in the step S105, comparison between the rotation change α and the amount reduction determination threshold value (H) or the amount reduction determination threshold value (L) is performed. That is to say, in the case where the rotation change α is a positive value, the comparison between the rotation change α and the amount reduction determination threshold value (H) is performed; in the case where the rotation change α is a negative value, the comparison between the rotation change α and the amount reduction determination threshold value (L) is performed. In the case where the result of the comparison in the step S105 indicates that [|rotation change α(+)|≤the amount reduction determination threshold value (H)] is established (Yes) or in the case where the result of the comparison in the step S105 indicates that [|rotation change α(−)|≥the amount reduction determination threshold value (L)] is established (Yes), it is determined that the combustion state is stable, and then the step S105 is followed by the step S106. In the case where the result of the comparison in the step S105 indicates that [|rotation change α(+)≤amount reduction determination threshold value (H)] is not established (No) or in the case where the result of the comparison in the step S105 indicates that [|rotation change α(−)≥the amount reduction determination threshold value (L)] is not established (No), the RF electric power is not reduced, and then the processing is ended.

In the step S106, a reduction amount for decreasing the RF electric power is determined, and then the processing is ended. However, when it is determined that the combustion is stable and a large correction is applied as in the step S104, the drivability may be deteriorated; thus, the reduction amount is set to be small. The setting of the reduction amount is performed, for example, in such a manner that the RF current value is decreased (decreased from 5 [A] to 4.8 [A]), that the RF application time is decreased (shortened from 500 [us] to 450 [us]), or that the number of multiple RF applications is decreased (for example, decreased from 5 times to 4 times). As is the case with the step S104, the reduction amount for the RF electric power may be a fixed value or may be changed depending on the operation condition; alternatively, based on the operation information, MAP may be provided. It is desirable that when the RF electric power is decreased, the lower limit value of the RF electric power is determined and clipping is applied thereto so that the RF electric power is prevented from becoming too small.

Next, in the step S107, because the combustion state is stable, the RF electric power is memorized. The RF electric power may be memorized, for example, by an EEPROM which is a nonvolatile memory, as a memory means. The memorization may be performed each time, at a timing when the RF electric power value becomes minimum, at a timing when several ignitions are implemented after the combustion state has become stable, at a timing when the power source becomes off, or the like. The memorized RF electric power is utilized as the initial value of the RF electric power at a time when the internal combustion engine starts next time, so that excessive application of the RF electric power can be suppressed. It may be allowed that RF electric power is memorized for each operation condition and then the initial value for each operation condition is set to the memorized RF electric power value.

As described above, the high-frequency discharge ignition apparatus according to Embodiment 1 of the present invention makes it possible to apply the optimum RF electric power in accordance with the combustion state determination based on the rotation change α; thus, when the combustion state is stable, AC plasma can be suppressed from abrading the electrodes of the ignition plug 110, by reducing the RF electric power. As a result, it is made possible that while the combustion state is stabilized, the lifetime of the ignition plug 110 for producing AC plasma is improved.

Embodiment 2

Figure 4:
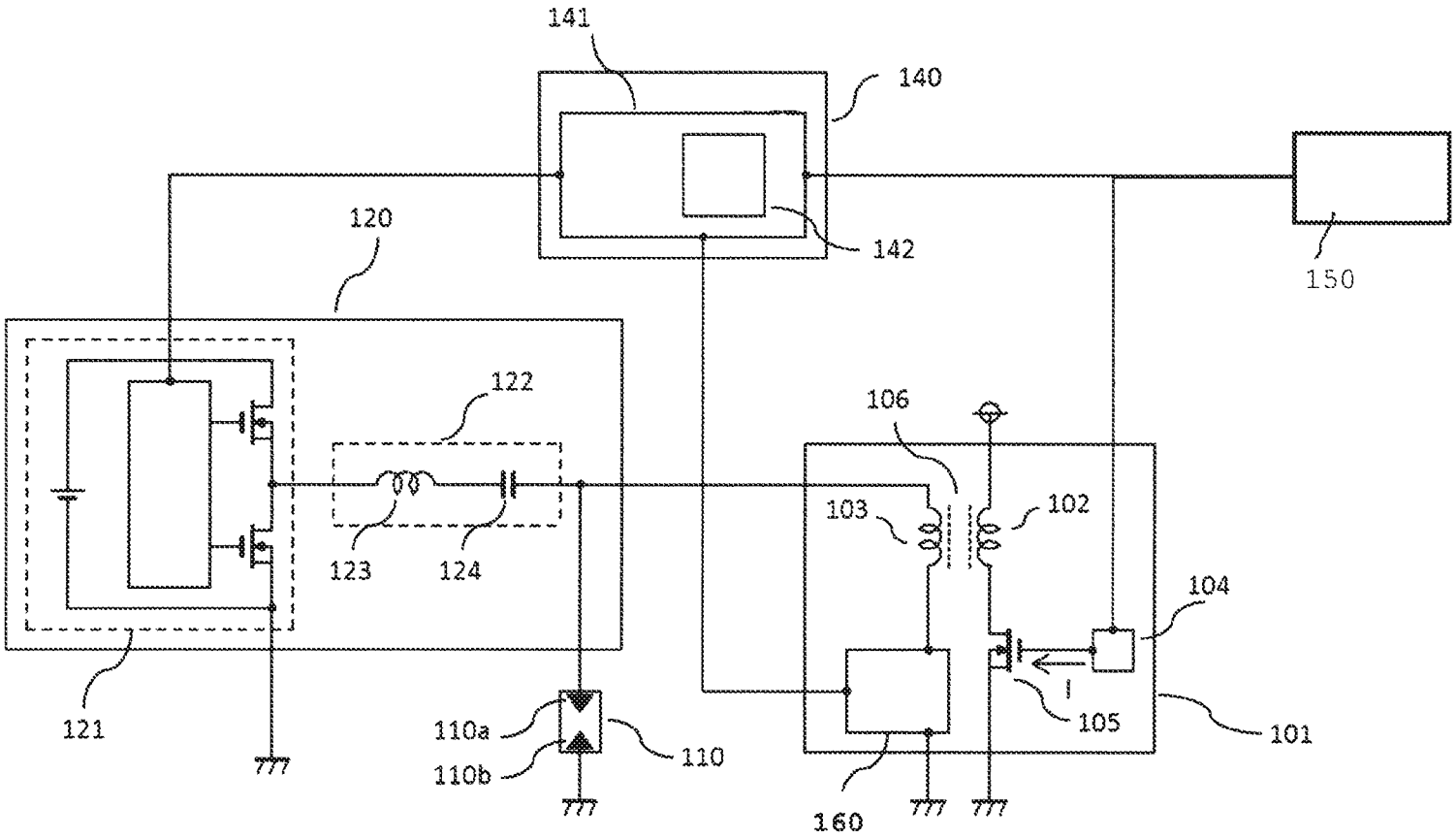
FIG. 4 is a configuration diagram of a high-frequency discharge ignition apparatus according to Embodiment 2 of the present invention.

Next, a high-frequency discharge ignition apparatus according to Embodiment 2 of the present invention will be explained. FIG. 4 is a configuration diagram of a high-frequency discharge ignition apparatus according to Embodiment 2 of the present invention. In contrast to the high-frequency discharge ignition apparatus according to foregoing Embodiment 1, the high-frequency discharge ignition apparatus according to Embodiment 2 of the present invention has an ion current detection apparatus 160, instead of the combustion state detection apparatus 130, in the ignition coil apparatus 101. The combustion state of the internal combustion engine is determined based on a signal obtained from the ion current detection apparatus 160. In addition, in FIG. 4, the reference numerals the same as those in FIG. 1 in Embodiment 1 denote the same or equivalent elements. The points different from Embodiment 1 will mainly be explained.

In order to detect an ion current by use of the secondary voltage of the ignition coil apparatus 101, the ion current detection apparatus 160 charges the ignition plug 110, as an ion-current detection probe, with a positive bias voltage. The switching device 105 is turned on order to energize the primary coil 102, so that energy is accumulated in the ignition coil apparatus 101. Then, when the switching device 105 is turned off in order to cut off the energization of the primary coil 102, a high-voltage DC electric power is generated across the secondary coil 103 and hence a spark discharge is made to occur in the gap between the central electrode 110*a* and the ground electrode 110*b* of the ignition plug 110.

In this situation, because the positive bias voltage is applied to the ignition plug 110 at a time after the discharge, an ion current flows through the gap between the central electrode 110*a* and the ground electrode 110*b* and hence the ion current detection apparatus 160 detects the ion current. As far as the ion current is concerned, ions to be generated at a time when an inflammable fuel-air mixture is combusted are detected, as the value of a current referred to as an ion current, the ion current detection apparatus 160. In Embodiment 2 of the present invention, as the detection probe for detecting an ion current, the ignition plug 110 is utilized; however, it may be allowed that in addition to the ignition plug of the ignition apparatus, a detection probe is provided and a power source for applying a voltage to the detection probe is provided; alternatively, it may be allowed that two or more ignition plugs are provided in a combustion chamber of the internal combustion engine so that an ion current is detected.

Figure 5:
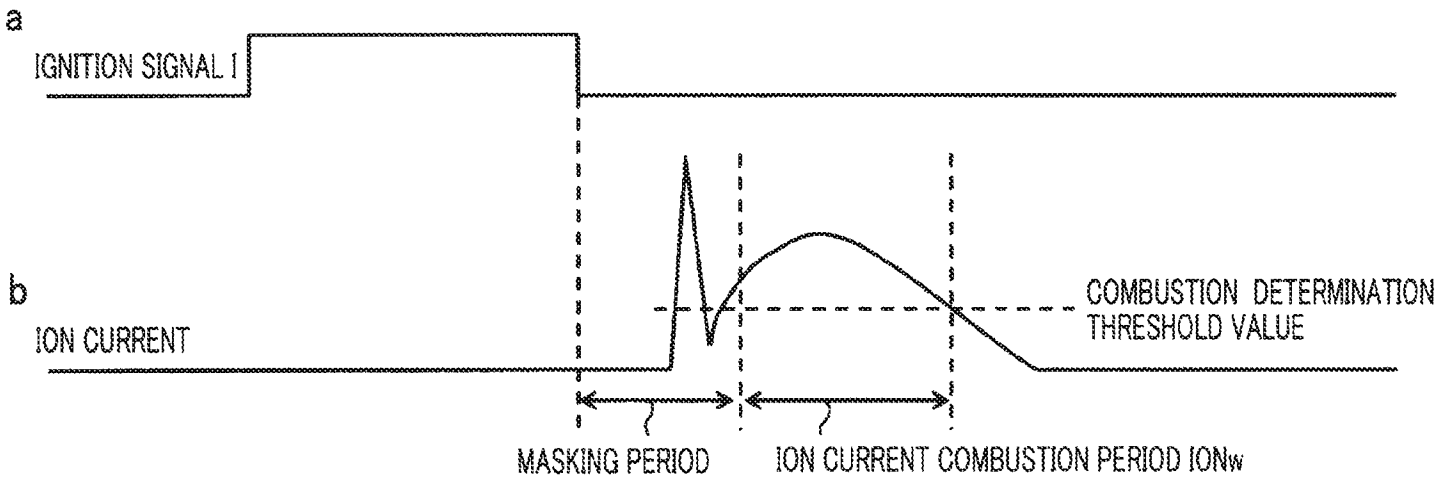
FIG. 5 is a waveform chart representing the ion-current combustion period in the high-frequency discharge ignition apparatus according to Embodiment 2 of the present invention.

Next, the detection method for an ion current will be explained in a specific manner. FIG. 5 is a waveform chart representing the ion-current combustion period in the high-frequency discharge ignition apparatus according to Embodiment 2 of the present invention; "a" and "b" represent the waveform of an ignition signal and the waveform of an ion current, respectively. In FIG. 5, noise that is caused when the bias is applied is masked during a masking period; then, based on data at a time after the masking period, it is determined whether or not an ion current has been generated. It is determined that the period in which the data exceeds a combustion determination threshold value is an ion current combustion period IONw and that the shorter the ion current combustion period IONw is, the more the combustion state has been deteriorated. In the case where the data does not exceed the combustion determination threshold value, it is determined that a misfire has occurred. Then, the ion current combustion period IONw is stored in the microprocessor 141 provided in the control apparatus 140.

Figure 6:
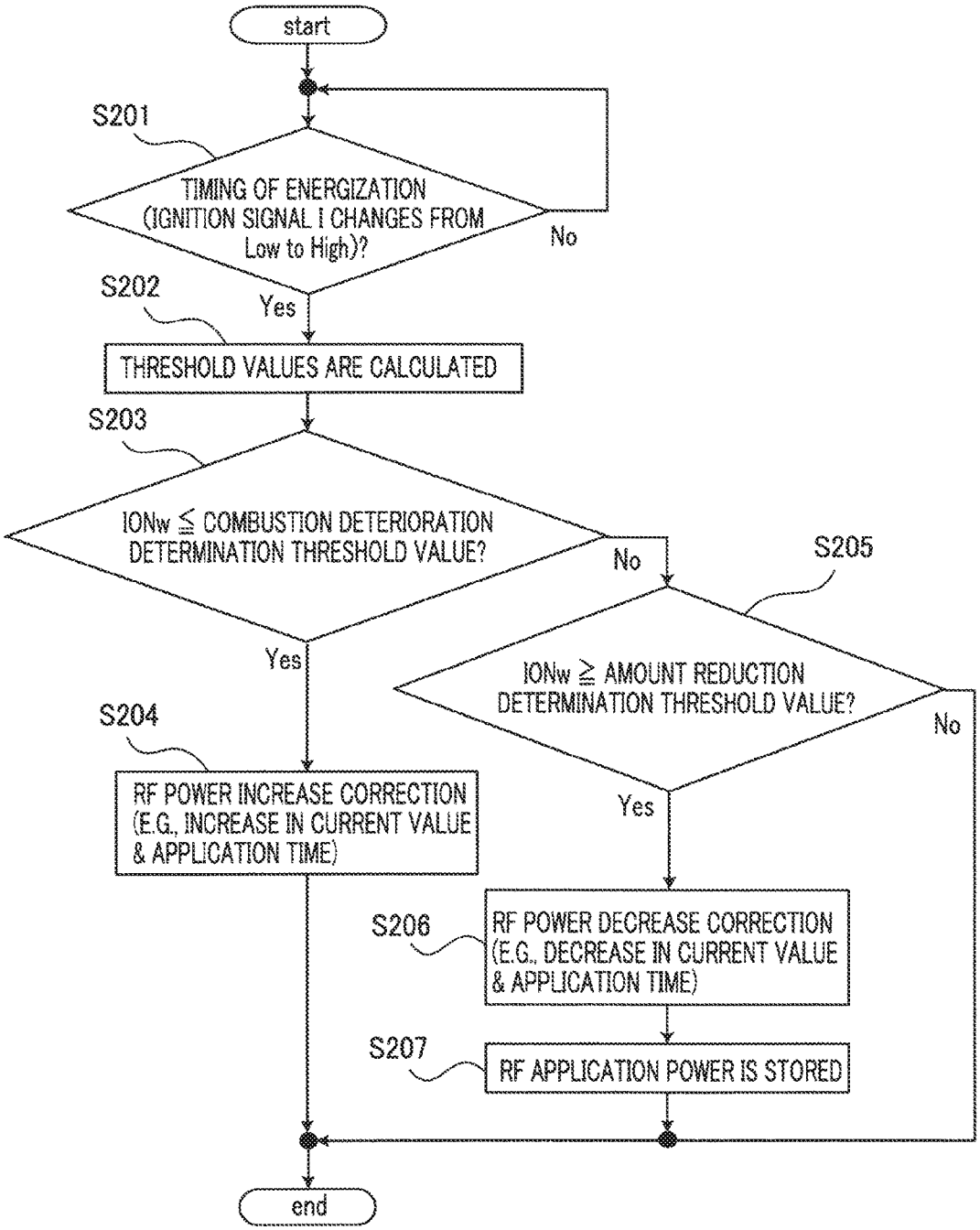
FIG. 6 is a flowchart representing the control procedure of the high-frequency discharge ignition apparatus according to Embodiment 2 of the present invention.

FIG. 6 is a flowchart representing the control procedure of the high-frequency discharge ignition apparatus according to Embodiment 2 of the present invention. In FIG. 6, at first, in the step S201, the ignition detection apparatus 142 in the control apparatus 140 detects the timing when the level of an ignition signal I of the driving apparatus 104 in the ignition coil apparatus 101 changes from Low level to High level. In this case, the timing when the level of the ignition signal I of the driving apparatus 104 changes from Low level to High level is the timing when the switching device 105 in the ignition coil apparatus 101 turns on and hence energization of the primary coil 102 starts. At that timing, the ion current combustion period IONw, of the 1-ignition-prior on current, that has been stored in the microprocessor 141 of the control apparatus 140 is read.

Figure 7:
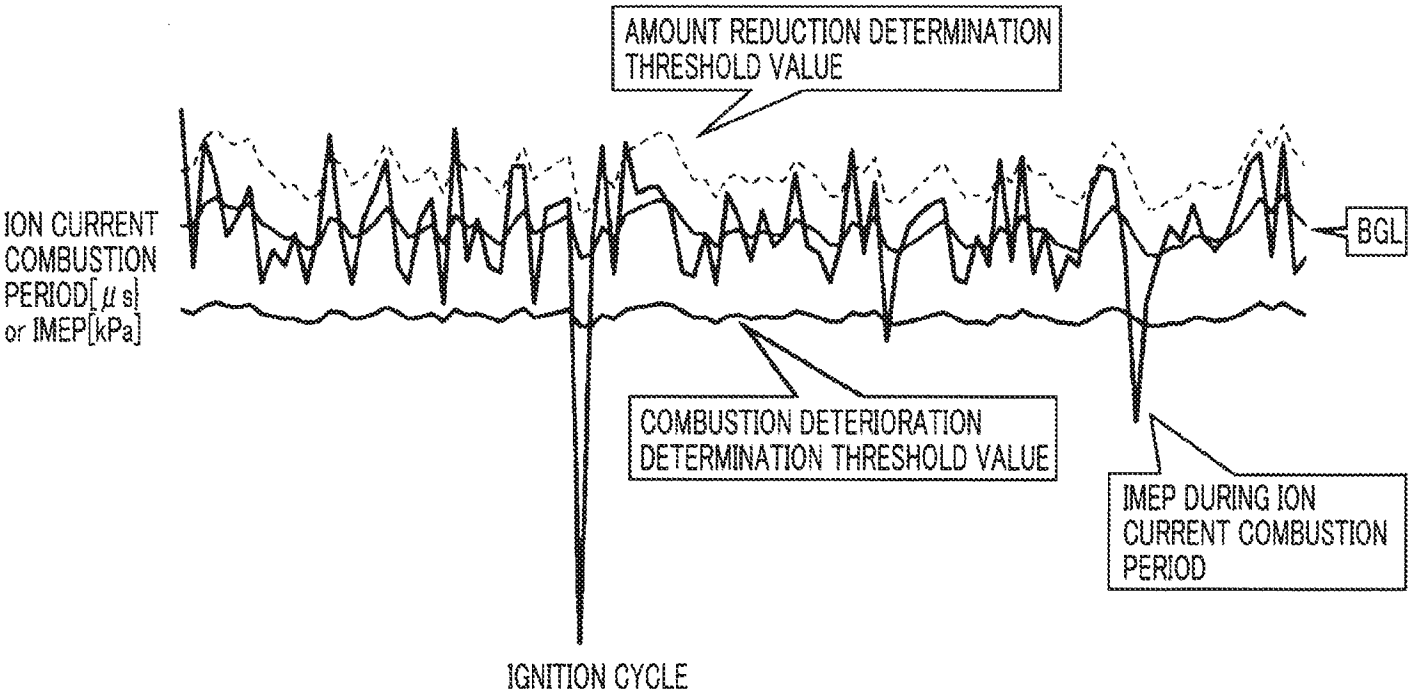
FIG. 7 is a waveform chart representing the background level and threshold values according to each of Embodiments 2 and 3 of the present invention.

In the step S202, determination threshold values are calculated. The determination threshold values are the same as those in Embodiment 1 described above; therefore, the explanations therefore will be omitted. FIG. 7 is a waveform chart representing the background level and threshold values according to each of Embodiments 2 and 3, described later, of the present invention; FIG. 7 represents BGL, an amount reduction determination threshold value, a combustion deterioration determination threshold value, and after-mentioned IMEP, which is an average effective pressure in a cylinder of the internal combustion engine during the ion current combustion period. It may be allowed that without utilizing BGL, the determination threshold values are set to fixed values based on respective maps for operation conditions of the internal combustion engine.

During the foregoing ion current combustion period IONw, the foregoing BGL is calculated by use of the before-mentioned equation (1), based on the rotation change $\alpha$. In Embodiment 2, in the equation (1), K, BGL (n—1), and Value denote the filter coefficient of BGL, 1-ignition-prior BGL, and the ion current combustion period IONw, respectively.

BGL, calculated according to the equation (1) is adopted as the reference; BGL is offset toward the negative side with respect to the reference so that the combustion deterioration determination threshold value is calculated. As is the case with Embodiment 1, the offset amount may be a fixed value or may be changed depending on the operation condition. It may be allowed that based on the operation information such as the rotation speed of the internal combustion engine, the load thereon, and the water temperature thereof, MAP is provided.

In the case where the ion current combustion period IONw is long, it is determined that the combustion state is stable, and then the RF electric power is reduced. Calculated BGL is adopted as the reference; BGL is offset toward the positive side with respect to the reference so that the amount reduction determination threshold value, with which it is determined that the combustion state is stable, is calculated. The offset amount is the proportion P (%) of the combustion deterioration determination threshold value to BGL. As is the case with the combustion deterioration determination threshold value, the proportion P (%) may be a fixed value or may be changed depending on the operation condition; alternatively, based on the operation information, MAP may be provided. In this situation, the amount reduction determination threshold value may be offset to the negative side with respect to BGL or may be set at each of both the positive and the negative sides.

After the threshold values are determined, comparison between the ion current combustion period IONw and the combustion deterioration determination threshold value is performed in the step S203; in the case where the result of the comparison indicates that [IONw≤combustion deterioration determination threshold value] is established (Yes), it is determined that the combustion state has been deteriorated, and then the step S203 is followed by the step S204. In contrast, in the case where the result of the comparison in the step S203 indicates that [IONw≤combustion deterioration determination threshold value] is not established (No), it is determined that the combustion state has not been deteriorated, and then the step S203 is followed by the step S205.

In the step S204, a correction amount for increasing the RF electric power is determined, and then the processing is ended. The determination of the correction amount is performed as is the case with Embodiment 1, for example, in such a manner that the RF current value is increased (for example, increased from 3 [A] to 5 [A]), that the RF application time is increased. (for example, prolonged from 100 [us] to 500 [us]), or that like multiple ignition, the RF is applied twice or more times. As is the case with the step S102, the correction amount for the RF electric power may be a fixed value or may be changed depending on the operation condition; alternatively, based on the operation information, MAP may be provided.

In the step S205, comparison between the ion current combustion period IONw and the amount reduction determination threshold value is performed; in the case where the result of the comparison indicates that [IONw≥amount reduction determination threshold value] is established (Yes), it is determined that the combustion state is stable, and then the step S205 is followed by the step S206. In contrast, in the case where [IONw≥amount reduction determination threshold value] is not established (No), it is determined that the combustion state is not stable enough to be able to reduce the RF electric power, and then the processing is ended without reducing the RF electric power.

Next, in the step S206, a reduction amount for decreasing the RF electric power is determined, and then the processing is ended. However, when it is determined that the combustion is stable and a large correction is applied as in the step S204, the drivability may be deteriorated; thus, the reduction amount is set to be small. As is the case with Embodiment 1, the setting of the reduction amount of the RF electric power is performed, for example, in such a manner that the RF current value is decreased (decreased from 5 [A] to 4.8 [A]), that the RF application time is decreased (shortened from 500 [us] to 450 [us]), or that the number of multiple RF applications is decreased (for example, decreased from 5 times to 4 times). The reduction amount of the RF electric power may be a fixed value or may be changed depending on the operation condition; alternatively, based on the operation information, MAP may be provided. It is desirable that when the RF electric power is decreased, the lower limit value of the RF electric power is determined and clipping is applied thereto so that the RF electric power is prevented from becoming too small.

In the step S207, because the combustion state is stable, the RF electric power is memorized. As is the case with Embodiment 1, the RF electric power may be memorized, for example, by an EEPROM which is a nonvolatile memory, as a memory means. The memorized RF electric power is utilized as the initial value of the RF electric power at a time when the internal combustion engine starts next time, so that excessive application of the RF electric power can be suppressed. It may be allowed that RF electric power is memorized for each operation condition and then the initial value for each operation condition is set to the memorized RF electric power value.

As described above, the high-frequency discharge ignition apparatus according to Embodiment 2 of the present invention makes it possible to apply the optimum RF electric power in accordance with the combustion state determination based on the ion current combustion period IONw; thus, when the combustion state is stable, AC plasma can be suppressed from abrading the electrodes of the ignition plug 110, by reducing the RF electric power. As a result, it is made possible that while the combustion state is stabilized, the lifetime of the ignition plug 110 for producing AC plasma is improved.

Embodiment 3

Next, a high-frequency discharge ignition apparatus according to Embodiment 3 of the present invention will be explained. FIG. 1, described above, is a configuration diagram of a high-frequency discharge ignition apparatus according to Embodiment 3 of the present invention. In contrast to foregoing Embodiment 1, in Embodiment 3, the combustion state detection apparatus 130 detects the combustion state of the internal combustion engine, based on the inner-cylinder pressure of the internal combustion engine detected by the inner-cylinder pressure sensor. In other words, the combustion state is determined based on a signal to be obtained from the inner-cylinder pressure sensor. In FIG. 1, the numerals that are the same as those in Embodiment 1 denote the same functions; thus, in the following explanation, the points different from Embodiment 1 will mainly be explained.

In FIG. 1, the combustion state detection apparatus 130 obtains an average effective pressure referred to as an IMEP, hereinafter) inside a cylinder of the internal combustion engine, based on the signal from the inner-cylinder pressure sensor, and detects a deterioration in the combustion, based on the IMEP. Because the calculation method for the IMEP is a well-known technique, the explanation therefore will be omitted, here.

Figure 8:
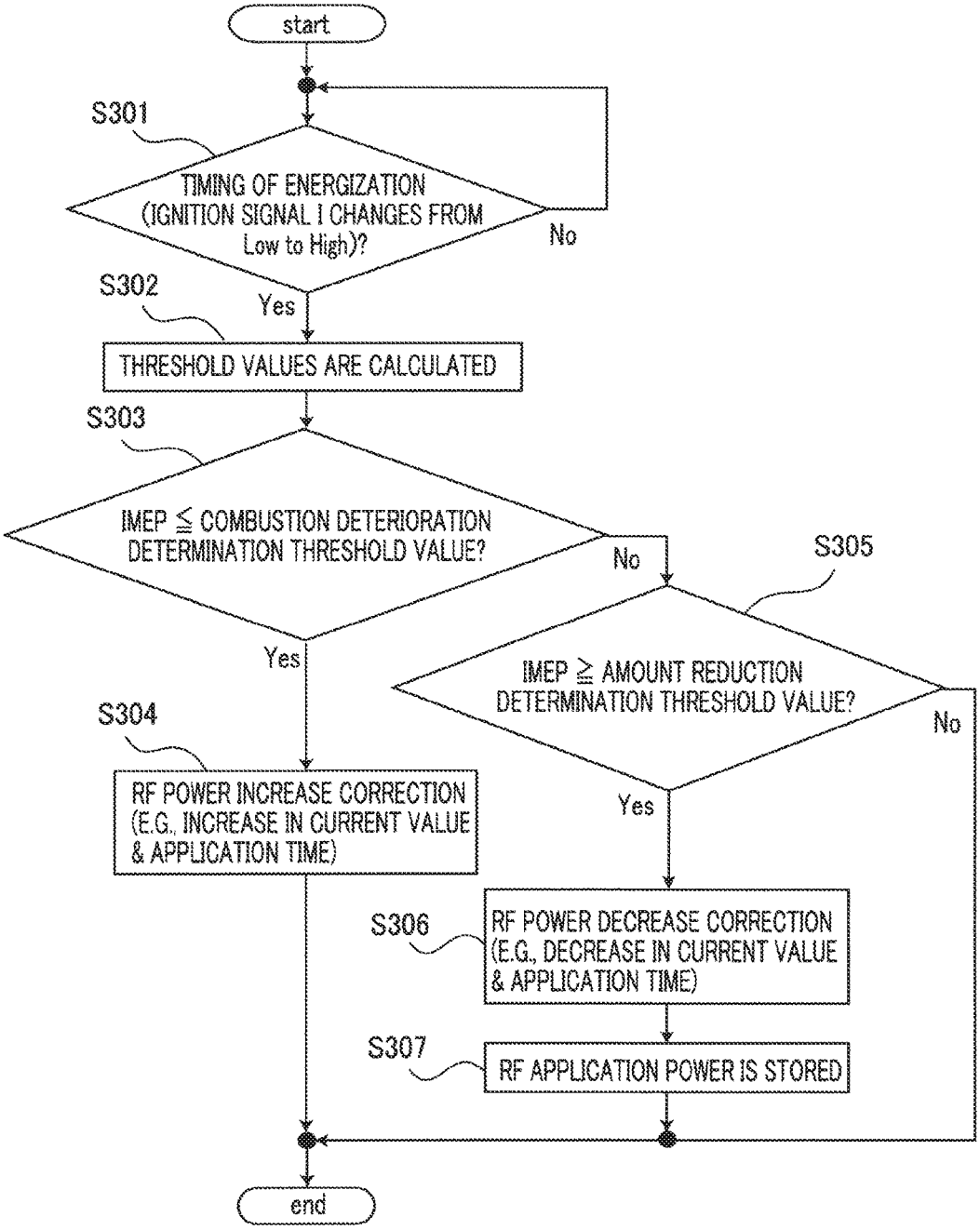
FIG. 8 is a flowchart representing the control procedure of a high-frequency discharge ignition apparatus according to Embodiment 3 of the present invention.

FIG. 8 is a flowchart representing the control procedure of the high-frequency discharge ignition apparatus according to Embodiment 3 of the present invention. In FIG. 8, at first, in the step S301, the ignition detection apparatus 142 in the control apparatus 140 detects the timing when the driving apparatus 104 in the ignition coil apparatus changes the level of an ignition signal I from Low level to High level. At that timing, the 1-ignition-prior IMEP that has been stored in the microprocessor 141 of the control apparatus 140 is read.

In the step S302, determination threshold values are calculated. The determination threshold values are the same as those in Embodiment 1 described above; therefore, the explanations therefore will be omitted, here. BIG. 7, described above, is a waveform chart representing the background level and threshold values applied also to Embodiment 3 of the present invention.

Based on the IMEP, the BGL is calculated by use of the equation (1) in Embodiment 1, described above. In Embodiment 3, in the equation (1), K, BGL (n−1), and Value denote the filter coefficient of BGL, 1-ignition-prior BGL, and the value of the IMEP, respectively.

BGL calculated according to the equation (1) is adopted as the reference; BGL is offset toward the negative side with respect to the reference so that the combustion deterioration determination threshold value is calculated. As is the case with Embodiment 1, the offset amount may be a fixed value or may be changed depending on the operation condition. It may be allowed that based on the operation information such as the rotation speed of the internal combustion engine, the load thereon, and the water temperature thereof, MAP is provided.

In the case where the IMEP is high, it is determined that the combustion state is stable, and then the RF electric power is reduced. Calculated BGL through the equation (1) is adopted as a reference; the amount reduction determination threshold value, with which it is determined that the combustion state is stable, is offset toward the positive side with respect to the reference. The offset amount is the proportion P (%) of the combustion deterioration determination threshold value to BGL. As is the case with the combustion deterioration determination threshold value, the proportion P (%) may be a fixed value or may be changed depending on the operation condition; alternatively, based on the operation information, MAP may be provided. The amount reduction determination threshold value may be offset to the negative side with respect to BGL or may be set at each of both the positive and the negative sides.

After the threshold values are determined, comparison between the IMEP and the combustion deterioration determination threshold value is performed in the step S303; in the case where the result of the comparison indicates that [IMEP≤combustion deterioration determination threshold value] is established (Yes), it is determined that the combustion state has been deteriorated, and then the step S303 is followed by the step S304. In contrast, in the case where [IMEP≤combustion deterioration determination threshold value] is not established (No), it is determined that the combustion state has not been deteriorated, and then the step S303 is followed by the step S305.

In the step S304, a correction amount for increasing the RF electric power is determined, and then the processing is ended. The determination means for the correction amount is the same as that in Embodiment 1, for example, in such a manner that the RF current value is increased (for example, increased from 3 [A] to 5 [A]), that the RF application time is increased (for example, prolonged from 100 [us] to 500 [us]), or that like multiple ignition, the RF is applied twice or more times. As is the case with the step S102, the correction amount for the RF electric power may be a fixed value or may be changed depending on the operation condition; alternatively, based on the operation information, MAP may be provided.

In the step S305, comparison between the IMEP and the amount reduction determination threshold value is performed; in the case where the result of the comparison indicates that [IMEP≤amount reduction determination threshold value] is established (Yes), it is determined that the combustion state is stable, and then the step S305 is followed by the step S306. In contrast, in the case where [IMEP≥amount reduction determination threshold value] is not established (No), it is determined that the combustion state is not stable enough to be able to reduce the RF electric power, and then the processing is ended without reducing the RF electric power.

In the step S306, a reduction amount for decreasing the RF electric power is determined, and then the processing is ended. However, when it is determined that the combustion is stable and a large correction is applied as in the step S104, the drivability may be deteriorated; thus, the reduction amount is set to be small. The setting of the reduction amount is performed, for example, in such a manner that the RF current value is decreased (decreased from 5 [A] to 4.8 [A]), that the RF application time is decreased (shortened from 500 [us] to 450 [us]), or that the number of multiple RF applications is decreased (for example, decreased from 5 times to 4 times). As is the case with the step S104, the reduction amount for the RF electric power may be a fixed value or may be changed depending on the operation condition; alternatively, based on the operation information, MAP may be provided. It is desirable that when the RF electric power is decreased, the lower limit value of the RF electric power is determined and clipping is applied thereto so that the RF electric power is prevented from becoming too small.

In the step S307, because the combustion state is stable, the RF electric power is memorized. As is the case with Embodiment 1, the RF electric power may be memorized, for example, by an EEPROM which is a nonvolatile memory, as a memory means. The memorized RF electric power is utilized as the initial value of the RF electric power at a time when the internal combustion engine starts next time, so that excessive application of the RF electric power can be suppressed. It may be allowed that RF electric power is memorized for each operation condition and then the initial value for each operation condition is set to the memorized RF electric power value.

As described above, the high-frequency discharge ignition apparatus according to Embodiment 3 of the present invention makes it possible to apply the optimum RF electric power in accordance with the combustion state determination based on the IMEP; thus, when the combustion state is stable, AC plasma can be suppressed from abrading the electrodes of the ignition plug 110, by reducing the RF electric power. As a result, it is made possible that while the combustion state is stabilized, the lifetime of the ignition plug 110 for producing AC plasma is improved.

In Embodiment 3, the IMEP is calculated by use of the inner-cylinder pressure sensor and then the combustion state is determined; however, the combustion state may be determined based on a combustion mass rate (MFB), a heat generation amount, or a heat generation rate.

Embodiment 4

Next, a high-frequency discharge ignition apparatus according to Embodiment 4 of the present invention will be explained. FIG. 1, described above, is a configuration diagram of the high-frequency discharge ignition apparatus according to Embodiment 4 of the present invention. In contrast to Embodiment 1, the combustion state detection apparatus 130 in Embodiment 4 is to detect whether or not the inflammable fuel-air mixture is lean, by use of an oxygen sensor (referred to as an O2 sensor, hereinafter). In FIG. 1, the numerals that are the same as those in Embodiment 1 denote the same functions; thus, in the following explanation, the points different from Embodiment 1 will mainly be explained.

Based on a signal from the O2 sensor, the combustion state detection apparatus 130 detects whether the inflammable fuel-air mixture is lean or rich. In the case where the inflammable fuel-air mixture is lean, unevenness is liable to occur in the distribution of the inflammable fuel-air mixture; thus, the combustion state is liable to become unstable. Therefore, in the case where it is determined that the inflammable fuel-air mixture is lean, the RF electric power is enlarged so as to increase the spatial igniting opportunity.

Figure 9:
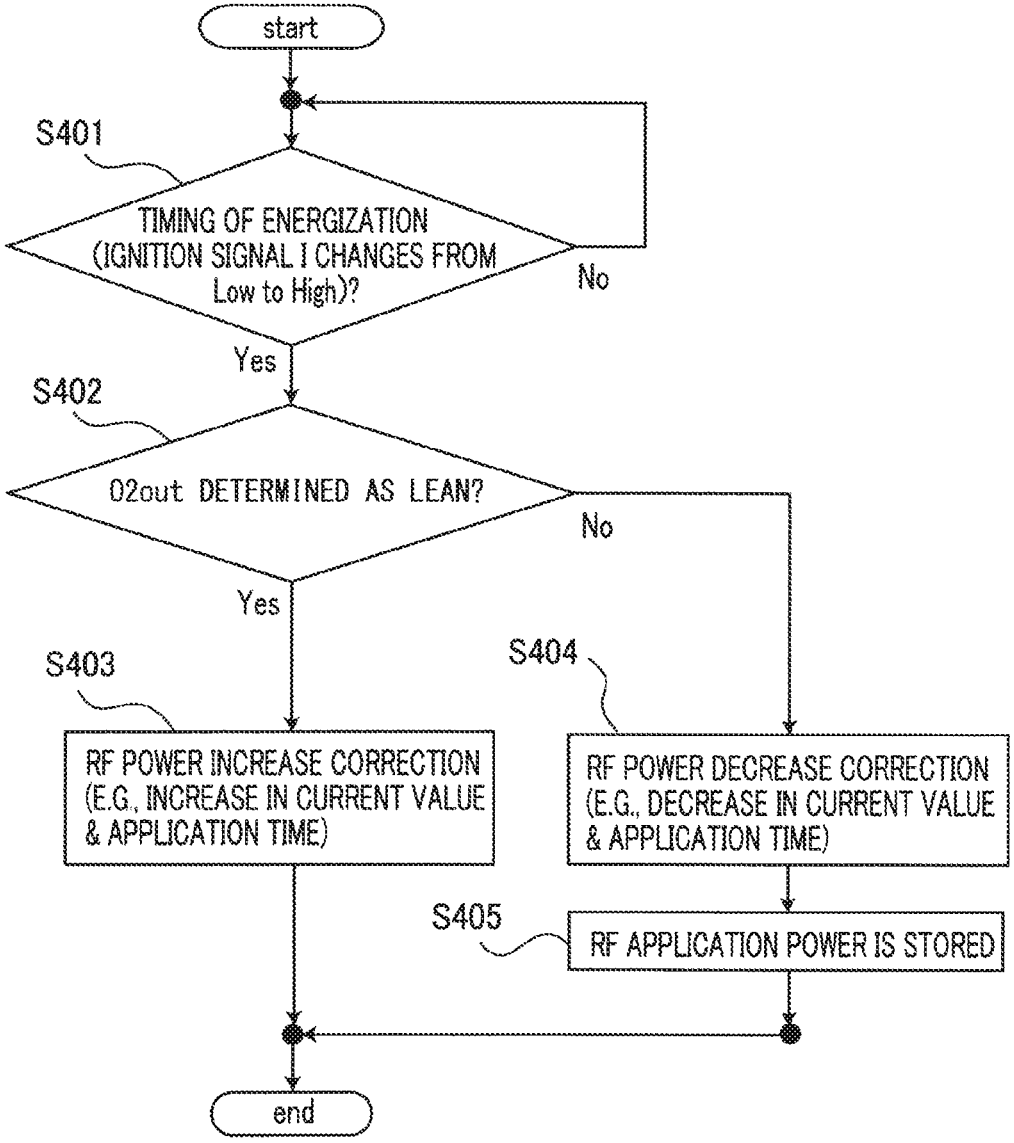
FIG. 9 is a flowchart representing the control procedure of a high-frequency discharge ignition apparatus according to Embodiment 4 of the present invention.

FIG. 9 is a flowchart representing the control procedure of the high-frequency discharge ignition apparatus according to Embodiment 4 of the present invention. In FIG. 9, at first, in the step S401, the ignition detection apparatus 142 in the control apparatus 140 detects the timing when the driving apparatus 104 in the ignition coil apparatus changes the level of an ignition signal I from Low level to High level. At that timing, the 1-ignition prior O2 sensor output state that has been stored in the microprocessor 141 of the control apparatus 140 is read.

In the step S402, it is determined whether or not the output O2out of the O2 sensor indicates the lean state; in the case where as the result of the determination, the output of the O2 sensor indicates the lean state (Yes), the step S402 is followed by the step S403. In contrast, in the case where the output O2out of the O2 sensor does not indicate the lean state (No), the step S402 is followed by the step S404. In the step S403, a correction amount for increasing the RF electric power is determined, and then the processing is ended. The determination of the correction amount is performed in the same manner as the determination of the correction amount in Embodiment 1, for example, in such a manner that the RF current value is increased (for example, increased from 3 [A] to 5 [A]), that the RF application time is increased (for example, prolonged from 100 [us] to 500 [us]), or that like multiple ignition, the RF is applied twice or more times. As is the case with the step S102, the correction amount for the RF electric power may be a fixed value or may be changed depending on the operation condition; alternatively, based on the operation information, MAP may be provided.

In the step S404, a reduction amount for decreasing the RF electric power is determined, and then the processing is ended. However, when a large correction is applied as in the step S403, the drivability may be deteriorated; thus, the reduction amount is set to be small. As is the case with Embodiment 1, the setting of the reduction amount of the RF electric power is performed, for example, in such a manner that the RF current value is decreased (decreased from 5 [A] to 4.8 [A]), that the RF application time is decreased (shortened from 500 [us] to 450 [us]), or that the number of multiple RF applications is decreased (for example, decreased from 5 times to 4 times). The reduction amount of the RF electric power may be a fixed value or may be changed depending on the operation condition; alternatively, based on the operation information, MAP may be provided. It is desirable that when the RF electric power is decreased, the lower limit value of the RF electric power is determined and clipping is applied thereto so that the RF electric power is prevented from becoming too small.

In the step S405, because the combustion state is not lean, the RF electric power is memorized. As is the case with Embodiment 1, the RF electric power may be memorized, for example, by an EEPROM which is a nonvolatile memory, as a memory means. The memorized RF electric power is utilized as the initial value of the RF electric power at a time when the internal combustion engine starts next time, so that excessive application of the RF electric power can be suppressed. It may be allowed that RF electric power is memorized for each operation condition and then the initial value for each operation condition is set to the memorized RF electric power value.

As described above, the high-frequency discharge ignition apparatus according to Embodiment 4 of the present invention makes it possible to apply the optimum RF electric power, depending on whether the O2 sensor indicates that the inflammable fuel-air mixture is lean or that the inflammable fuel-air mixture is rich; thus, when the combustion state is not lean, AC plasma can be suppressed from abrading the electrodes of the ignition plug 110, by reducing the RF electric power. As a result, it is made possible that while the combustion state is stabilized, the lifetime of the ignition plug 110 for producing AC plasma is improved.

In each of foregoing Embodiments 1 through 4, the control processing by the high-frequency discharge ignition apparatus has been described from the energization starting timing, as a starting point, at which the level of the ignition signal I from the driving apparatus 104 changes from Low to High; however, the energization cutoff timing at which the level of the ignition signal I changes from High to Low may be adopted, as the starting point; alternatively, the control processing may be performed every constant time.

A high-frequency discharge ignition apparatus according to the present invention is mounted in an automobile, a motorcycle, an outboard engine, an extra machine, or the like utilizing an internal combustion engine, and is capable of securely igniting an inflammable fuel-air mixture; therefore, the high-frequency discharge ignition apparatus makes it possible to effectively operate the internal combustion engine, and hence contributes to the environment preservation and to the solution of the problem of fuel depletion.

The present invention is not limited to the high-frequency discharge ignition apparatus according to each of Embodiments 1 through 4; in the scope within the spirits of the present invention, the configurations of Embodiments 1 through 4 can appropriately be combined with one another, can partially be modified, or can partially be omitted.

What is claimed is:

1. An internal combustion engine ignition apparatus comprising:

an ignition plug that is provided with two or more electrodes facing each other through a gap and produces a spark discharge in the gap so that an inflammable fuel-air mixture inside a combustion chamber of an internal combustion engine is ignited;

an ignition coil apparatus that supplies a predetermined ignition voltage to the ignition plug so as to form a spark discharge path in the gap;

a resonance apparatus that comprises an inductor and a capacitor to form a band-pass filter;

a current source that supplies an alternating current (AC) current to the spark discharge path formed in the gap, by way of the resonance apparatus;

a combustion state detection apparatus comprising a rotation speed sensor to detect a rotation speed of the internal combustion engine and to determine a combustion state inside the combustion chamber of the internal combustion engine based on the rotation speed; and a microprocessor that calculates a combustion deterioration determination threshold range based on change in the rotation speed of the internal combustion engine, compares the change in the rotation speed with the combustion deterioration determination threshold range, increases a value of the AC current in response to the change in the rotation speed being outside the combustion deterioration determination threshold range, and decreases the value of the AC current in response to the change in the rotation speed being within the combustion deterioration determination threshold range.

2. The internal combustion engine ignition apparatus according to claim 1, wherein the microprocessor is configured to acquire a control value for controlling the AC current of the current source.

3. The internal combustion engine ignition apparatus according to claim 1, wherein in accordance with an output of the combustion state detection apparatus, the microprocessor controls at least one of a level, a supply period, and a number of supply instances of the AC current of the current source.

4. The internal combustion engine ignition apparatus according to claim 3, wherein the combustion state detection apparatus determines the combustion state inside the combustion chamber, based on the change in the rotation speed of the internal combustion engine.

5. The internal combustion engine ignition apparatus according to claim 3, wherein the microprocessor is configured to acquire a control value for controlling the AC current of the current source.

* * * * *